US009316173B2

(12) United States Patent
Highum

(10) Patent No.: US 9,316,173 B2
(45) Date of Patent: Apr. 19, 2016

(54) CYLINDER LINER WITH BONDING LAYER

(71) Applicant: Federal-Mogul Corporation, Southfield, MI (US)

(72) Inventor: Eric Allan Highum, Howell, MI (US)

(73) Assignee: Federal-Mogul Corporation, Southfield, MI (US)

( * ) Notice: Subject to any disclaimer, the term of this patent is extended or adjusted under 35 U.S.C. 154(b) by 0 days.

(21) Appl. No.: 14/332,586

(22) Filed: Jul. 16, 2014

(65) Prior Publication Data

US 2015/0020757 A1 Jan. 22, 2015

Related U.S. Application Data

(60) Provisional application No. 61/846,973, filed on Jul. 16, 2013.

(51) Int. Cl.

| | |
|---|---|
| ***F01P 7/14*** | (2006.01) |
| ***F02F 1/00*** | (2006.01) |
| ***F02F 1/10*** | (2006.01) |

(Continued)

(52) U.S. Cl.

CPC ..... *F02F 1/004* (2013.01); *B22D 19/0009* (2013.01); *B22D 19/0081* (2013.01); *F02F 1/10* (2013.01); *F02F 1/102* (2013.01); *F01P 7/16* (2013.01); *F01P 7/167* (2013.01); *F01P 2007/146* (2013.01); *F01P 2025/62* (2013.01); *F01P 2060/08* (2013.01); *Y10T 29/49272* (2015.01)

(58) Field of Classification Search

CPC ..... F01P 7/16; F01P 7/167; F01P 2007/146; F01P 2060/08; F01P 2025/62

USPC ..... 123/41.1

See application file for complete search history.

(56) References Cited

U.S. PATENT DOCUMENTS

| | | | | |
|---|---|---|---|---|
| 5,469,817 | A * | 11/1995 | Hoag | F02F 1/14 123/41.79 |
| 6,479,165 | B2 | 11/2002 | Fischer et al. | |
| 6,640,765 | B2 | 11/2003 | Land et al. | |

(Continued)

FOREIGN PATENT DOCUMENTS

| | | | |
|---|---|---|---|
| DE | 19729017 | A1 | 2/1999 |
| DE | 102005004486 | A1 | 8/2006 |
| DE | 102009043566 | A1 | 4/2011 |

OTHER PUBLICATIONS

International Search Report, mailed Nov. 11, 2014 (PCT/US2014/046782).

*Primary Examiner* — Lindsay Low
*Assistant Examiner* — Charles Brauch
(74) *Attorney, Agent, or Firm* — Robert L. Stearns; Dickinson Wright, PLLC

(57) ABSTRACT

A cylinder liner for an engine block assembly of an internal combustion engine is provided. The cylinder liner includes a liner member formed of cast iron and presenting an outer surface. A first portion of the outer surface of the liner member is machined to a reduced outside diameter. An aluminum-based material is then thermally sprayed onto the machined first portion, while a second portion of the outer surface remains uncoated. The coated cylinder liner is then placed in a mold, and another aluminum-based material is cast around the coated cylinder liner to form the engine block assembly. During the casting process, the two aluminum-based materials form a strong intermetallic bond between the liner member and the engine block.

18 Claims, 3 Drawing Sheets

(51) Int. Cl.
*B22D 19/00* (2006.01)
*F01P 7/16* (2006.01)

(56) References Cited

U.S. PATENT DOCUMENTS 7,513,236 B2 4/2009 Miyamoto et al.
7,533,647 B2 5/2009 Miyamoto et al.
7,685,987 B2 3/2010 Miyamoto et al.
7,753,023 B2 7/2010 Takami et al.
7,757,652 B2 7/2010 Miyamoto et al.
7,882,818 B2 2/2011 Takami et al.
8,037,860 B2 10/2011 Takami et al.
2003/0056645 A1 3/2003 Land et al.
2007/0012177 A1* 1/2007 Miyamoto ..... B22D 19/0009 92/171.1
2010/0031914 A1 2/2010 Fukaumoto et al.

* cited by examiner

FIG. 4
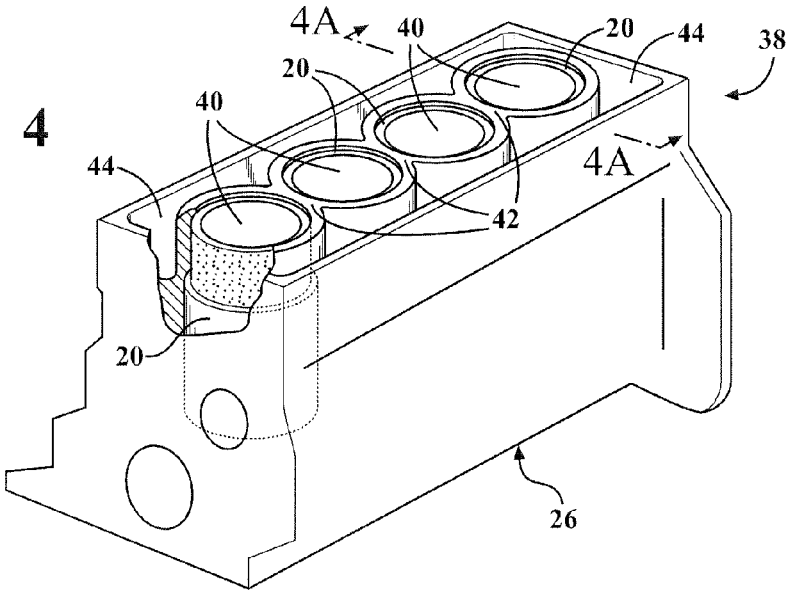
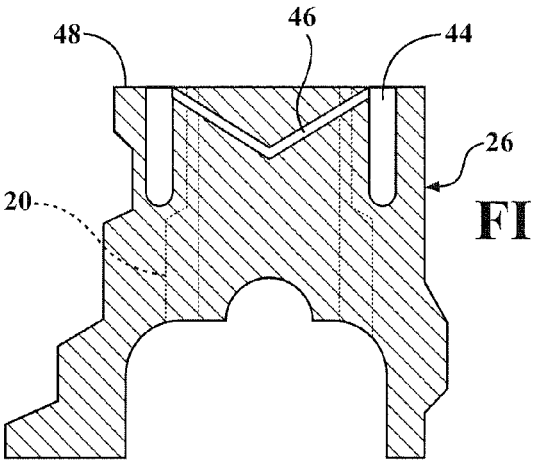
FIG. 4A
FIG. 5
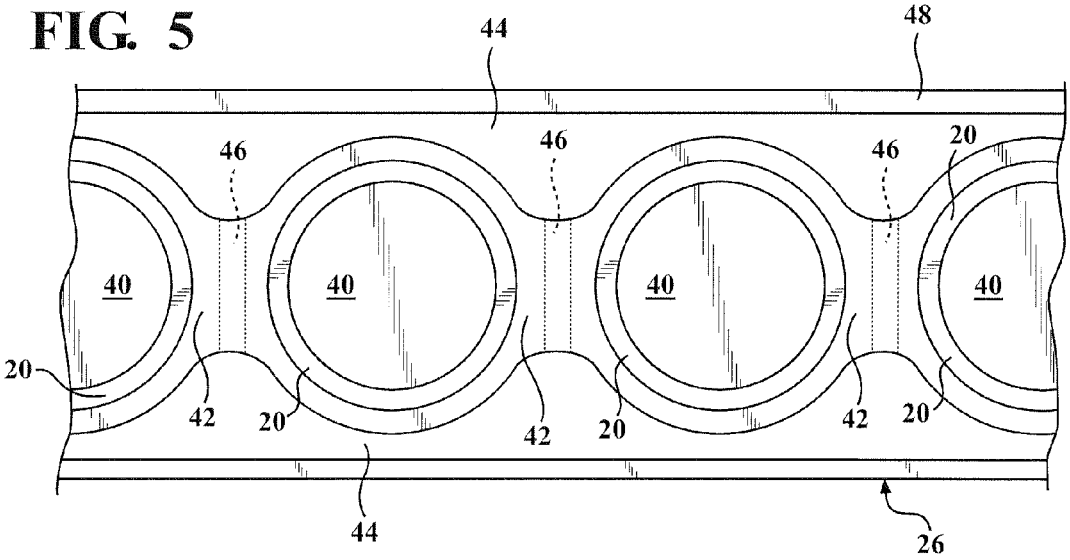

FIG. 6
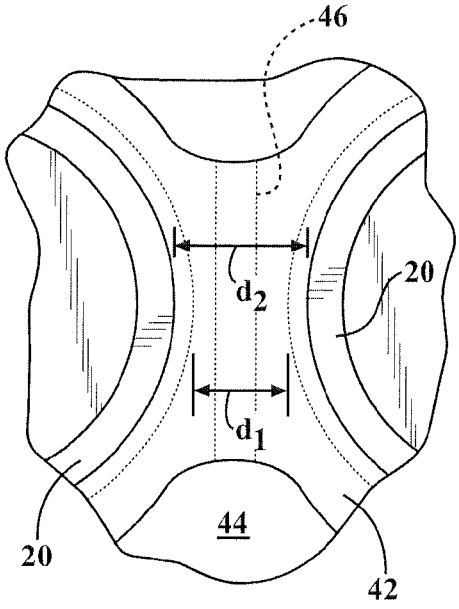
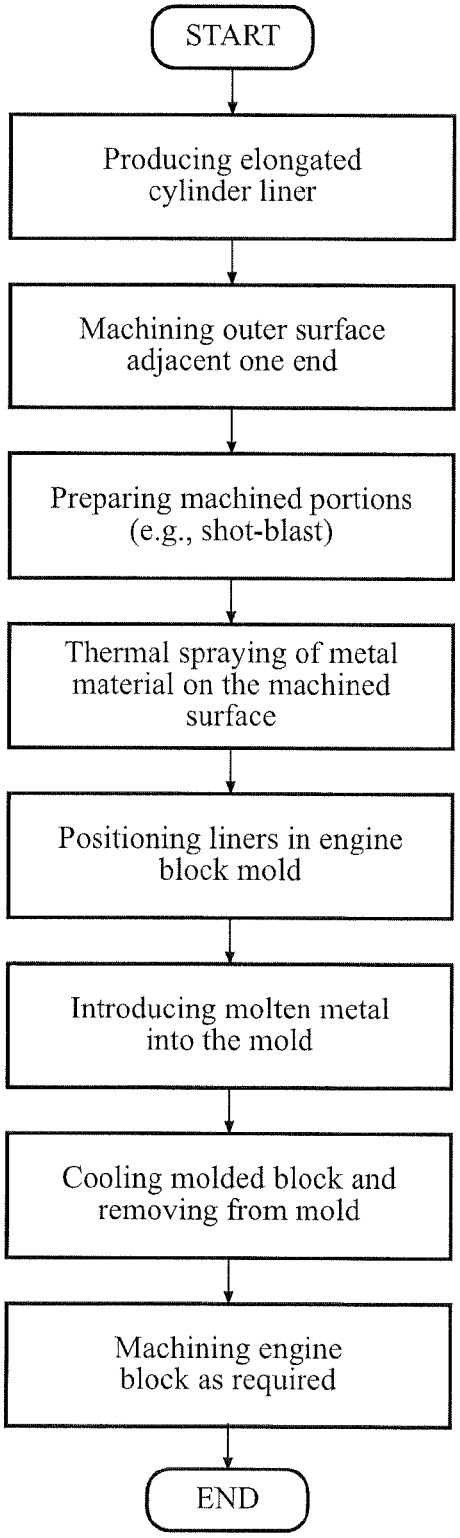
FIG. 7

CYLINDER LINER WITH BONDING LAYER

CROSS REFERENCE TO RELATED APPLICATION

This U.S. utility patent application claims the benefit of U.S. provisional patent application Ser. No. 61/846,973, filed Jul. 16, 2013, the entire content of which is incorporated herein by reference in its entirety.

BACKGROUND OF THE INVENTION

1. Field of the Invention

The invention relates generally to cylinder liners for internal combustion engines, engine block assemblies including the cylinder liners, and methods of manufacturing the same.

2. Description of the Prior Art

Engines today are preferably designed to be smaller and lighter in order to condense packaging, reduce engine mass, and improve fuel economy. However, the smaller size can cause problems and concerns for finding places and positions for various components and machining. One of the areas of concern is the smaller interbore bridge area between the piston cylinder openings in the engine block. When cooling of the interbore bridges is necessary, drilled holes and/or saw slots can be machined into the bridge areas. Given the smaller bore spacing, and if liners are positioned in the cylinders, it can be difficult to machine the saw slots and/or drill the holes without contacting the cylinder liners and damaging the cutting tools. This can cause scrappage of the engine block and/or block line downtime.

Turning down the outside surface of the cylinder liners can create some additional space in the interbore bridge regions for slot and hole machining. However, this can result in poor thermal conductivity and large magnitudes of bore distortion due to the lack of physical or mechanical bonding of the cylinder liner to the engine block. These conditions are undesirable in these critical regions of the engine block.

SUMMARY OF THE INVENTION

One aspect of the invention provides a cylinder liner for an internal combustion engine which provides for improved bonding to an engine block. The cylinder liner includes a liner member extending longitudinally from a top end to a bottom end and presenting a length between the top and bottom ends. The liner member includes an inside surface extending around a center axis and an oppositely facing outside surface. The outside surface presents a first outside diameter along a first portion of the length and a second outside diameter along a second portion of the length, wherein the first outside diameter is less than the second outside diameter. A bonding layer formed of an aluminum-based material is applied to the outside surface along the first portion of the liner member.

The invention also provides a method of manufacturing the improved cylinder liner. The method includes providing the liner member with the first outside diameter along the first portion of the length and the second outside diameter along the second portion of the length. The method further includes applying a layer of an aluminum-based material to the outside surface along the first portion of the length of the liner member.

Another aspect of the invention provides an engine block assembly including a plurality of the cylinder liners. Each cylinder liner includes the liner member and a layer of a first aluminum-based material applied to the outside surface along the first portion. The assembly also includes a block formed of a second aluminum-based material and presenting a plurality of bores each for receiving one of the cylinder liners. The first aluminum-based material of the cylinder liners is bonded to the second aluminum-based material of the block.

The invention also provides for a method of manufacturing the engine block assembly. The method includes providing the plurality of cylinder liners, and disposing the plurality of cylinder liners in a mold. The method next includes casting the second aluminum-based material around the plurality of cylinder liners in the mold.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 4 is a schematic view of the engine block assembly including the plurality of cylinder liners according to an exemplary embodiment of the invention;

FIG. 4A is cross-sectional view of the engine block assembly of FIG. 4 along line 4A;

FIG. 5 is a top view of the engine block assembly of FIG. 4;

FIG. 6 is an enlarged top view of a portion of the engine block assembly shown in FIGS. 4 and 5; and FIG. 7 illustrates steps of a method of manufacturing the engine block assembly according to an exemplary embodiment of the invention.

DETAILED DESCRIPTION OF AN ENABLING EMBODIMENT

Figure 1:
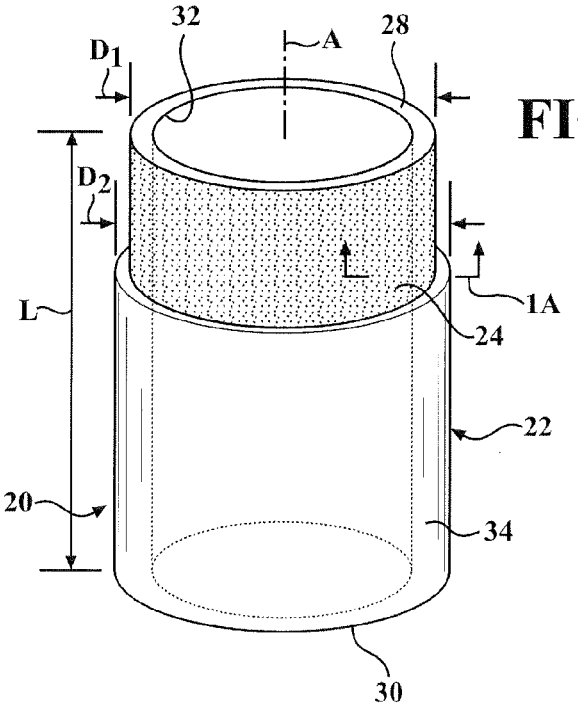
FIG. 1 is schematic view of a cylinder liner according to an exemplary embodiment of the invention.

One aspect of the invention provides a cylinder liner 20 for an internal combustion engine with a liner member 22 and a bonding layer 24, as shown in FIG. 1. The bonding layer 24 provides improved bonding and enhanced thermal conductivity between the metal material of the liner member 22 and the surrounding cast metal material which forms an engine block 26. The bonding layer 24 also provides for increased space between adjacent cylinder liners 22 in the engine block 26.

The cylinder liner 20 includes a liner member 22 formed of a metal material. In an exemplary embodiment, the metal material used to form the liner member 22 is cast iron, but the liner member 22 can alternatively be formed of steel or another metal material capable of withstanding the temperature, pressures, and other conditions of an internal combustion engine. The metal material used to form the liner member 22 is different from the metal material of the surrounding engine block 26, and the metal material of the liner member 22 typically does not physically and chemically bond to the engine block 26 without the bonding layer 24.

As shown in FIG. 1, the liner member 22 extends longitudinally from a top end 28 to a bottom end 30 and presents a length L between the top and bottom ends 28, 30. In the exemplary embodiment, the length L of the liner member 22 ranges from 100 millimeters to 150 millimeters. The liner member 22 also includes an inside surface 32 extending around a center axis A and an oppositely facing outside surface 34. The inside surface 32 of the liner member 22 extends circumferentially around the center axis A and presents a cylindrical-shaped opening extending from the top end 28 to the bottom end 30.

Figure 1A:
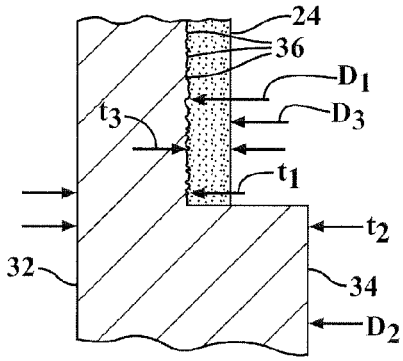
FIG. 1A is an enlarged view of a portion of the cylinder liner of FIG. 1 at line 1A.

The outside surface 34 of liner member 22 also extends circumferentially around the center axis A and presents a cylindrical-shaped surface extending from the top end 28 to the bottom end 30. The outside surface 34 has a first outside diameter $D_1$ along a first portion of the length L and a second outside diameter $D_2$ along a second portion of the length L. As shown in FIG. 1, the first outside diameter $D_1$ is less than the second outside diameter $D_2$. In the exemplary embodiment, the first portion is machined a distance radially relative to the center axis A to present the reduced first outside diameter $D_1$. However, other methods can be used to reduce the first outside diameter $D_1$ so that it is less than the second outside diameter $D_2$. The liner member 22 also has a thickness $t_1$, $t_2$ extending from the outside surface 34 to the inside surface 32, as shown in FIG. 1A. The thickness $t_1$ along the machined first portion of the liner member 22 is typically 10 to 15 millimeters less than the thickness $t_2$ along the second portion. The thickness $t_1$, $t_2$ of the liner member 22 can vary depending on the application, but typically the thickness $t_1$ along the first portion of the liner member 22 is at least 1.8 millimeters.

The first portion with the reduced first outside diameter $D_1$ and reduced thickness $t_1$ extends along a portion of the length L of the liner member 22 which is less than 100% of the length L of the liner member 22. The second portion also extends along a portion of the length L of the liner member 22 which is less than 100% of the length L. The first portion of the outside surface 34 is typically 10% to 50% of the length L of the liner member 22, and more typically 20 to 30% of the length L of the liner member 22. The first portion is typically located adjacent to one of the ends 28 or 30 of the liner member 22, in which case the second portion extends from the first portion to the opposite end 28 or 30. For example, the first portion can be located adjacent the top end 28 of the liner member 22, as shown in FIG. 1, which is positioned upwardly in the engine block 26 toward a manifold. Alternatively, the first portion could be spaced from both ends 28, 30 of the liner member 22, for example the first portion could be disposed in the center of the liner member 22. In this alternate case, the second portion would be located in two discrete areas each extending from one end 28, 30 of the liner member 22 to the first portion. In yet another embodiment, the liner member 22 could include a plurality of the machined first portions disposed in any location and spaced from one another by the second portions.

The first outside diameter $D_1$ along the length L of the first portion of the liner member 22 is typically constant. However, small variations in the first outside diameter $D_1$ may be present. For example, the first outside diameter $D_1$ may vary by not more than 1 millimeter along the length L of the first portion. In one embodiment, the first portion of the outside surface 34 is shot-blasted before the bonding layer 24 is applied. The shot-blasting process forms a plurality of depressions 36 along the outside surface 34 to assist in adhering the bonding layer 24 to the liner member 22, as shown in FIG. 1A. Each depression 36 typically has a depth of not greater than 1 millimeter.

The second outside diameter $D_2$ along the length L of the second portion of the liner member 22 is also typically constant. However, small variations in the second outside diameter $D_2$ may also be present. For example, the second outside diameter $D_2$ may vary by not more than 1 millimeter along the length L of the second portion. In an alternate embodiment, the second outside diameter $D_2$ varies more significantly along the second portion of the length L. For example, the outside surface 34 can present a plurality of protrusions (not shown), such as ribs or nubs, extending radially outwardly relative to the surrounding portion of the outside surface 34. The outside surface 34 along the second portion could alternatively comprise another type of engineered surface (not shown). The protrusions or other type of engineered surface can provide an improved mechanical connection between the liner member 22 and the surrounding cast engine block 26.

The bonding layer 24 applied to the liner member 22 is formed of an aluminum-based material. The bonding layer 24 typically covers the entire first portion of the outside surface 34, but could cover only a section of the first portion. The aluminum-based material applied to the liner member 22, referred to as a first aluminum-based material, is typically the same as or similar to a second aluminum-based material used to form the engine block 26. Thus, a strong bond is formed when the second aluminum-based material is cast around the first aluminum-based material. The bonding layer 24 also has a thickness $t_3$ which can vary. Preferably, the bonding layer 24 provides an outside diameter $D_3$ which is not greater than the second outside diameter $D_2$ of the liner member 22, as shown in FIG. 1A. In one embodiment, the thickness $t_3$ is not greater than 15 millimeters, for example 10-15 millimeters. The bonding layer 24 can comprise a single layer or a plurality of layers 24 to achieve the desired thickness $t_3$.

In one exemplary embodiment, the aluminum-based material used to form the bonding layer 24 is an aluminum alloy, including aluminum in an amount of 85 to 90 weight percent (wt. %), silicon in an amount of 10 to 15 wt. %, oxygen in an amount of 0.05 to 0.15 wt. %, and optionally Fe, Mg, Zn, and Mn in a total amount less than 1 wt. %, based on the total weight of the aluminum alloy. In this exemplary embodiment, the bonding layer 24 also has a porosity of less than 5%, a thermal conductivity of 80 to 120 W/mK at 50 to 400° C., a thermal expansion coefficient of 20 to $24\times10^{-6}$/K at 20 to 150° C., a tensile strength of at least 170 MPa, and an elastic modulus of 40 to 70 GPa.

In the exemplary embodiment, the bonding layer 24 is applied to the outside surface 34 by thermal spraying, such as plasma spraying. However, other methods can be used to apply the bonding layer 24 to the liner member 22.

Another aspect of the invention provides a method of manufacturing the cylinder liner 20. The method first includes providing the liner member 22, such as the liner member 22 described above. The geometry of the liner member 22, however, can vary. The method next includes preparing the liner member 22 for application of the bonding layer 24. This typically includes radially machining a portion of the outside surface 34 of the liner member 22 to form the first portion having the reduced first outside diameter $D_1$. However, other methods besides machining can be used to form the reduced first outside diameter $D_1$.

To further prepare liner member 22 for application of the bonding layer 24, the method typically includes activating the outside surface 34 along the machined first portion. This step includes removing any contaminants, oil, or corrosion from the outside surface 34. The method can also include forming a rough texture along the first portion, for example by shot-blasting, as described above. The shot-blasting process forms a plurality of depressions 36 which assist in adhering the bonding layer 24 to the liner member 22.

Figure 2:
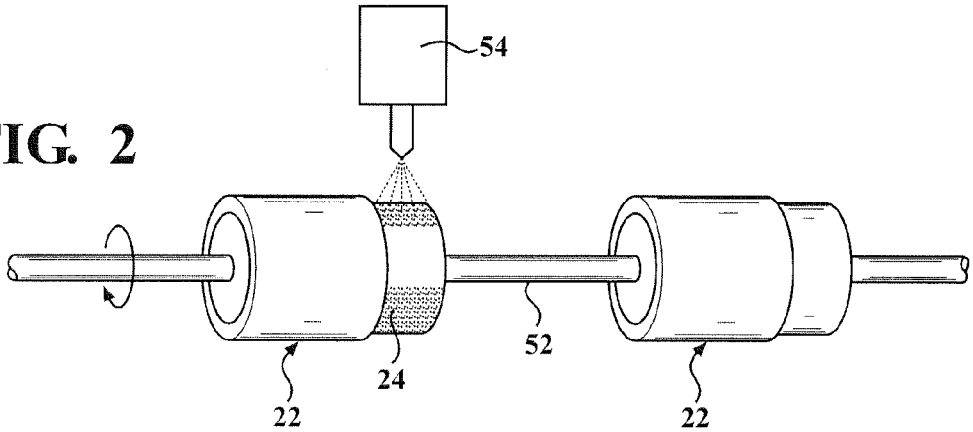
FIG. 2 illustrates a thermal spraying step in a method of manufacturing the cylinder liner according to an exemplary embodiment of the invention.
Figure 3:
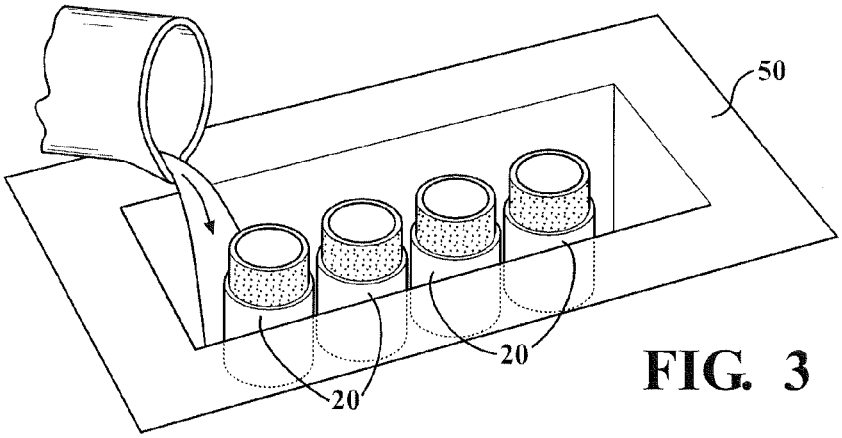
FIG. 3 illustrates a casting step in a method of manufacturing an engine block assembly including a plurality of the cylinder liners according to an exemplary embodiment of the invention.

The step of applying the layer of the aluminum-based material, referred to the first aluminum-based material, to the outside surface 34 along the first portion preferably includes thermal spraying. Any type of thermal spraying technique can be used, for example plasma spraying. FIG. 2 illustrates the step of applying the first aluminum-based material to the liner member 22 according to one exemplary embodiment, which can be used in an automated process or in a production process. In this embodiment, a plurality of the machined liner member 22 are positioned on a rotating shaft 52 and thermally sprayed by a thermal spray apparatus 54 while moving longitudinally relative to the thermal spray apparatus 54. However, the bonding layer 24 formed of the first aluminum-based material could alternatively be applied to the first portion of the liner member 22 using other methods. The step of applying the bonding layer 24 to the liner member 22 can include forming a single layer or a plurality of layers 24 to achieve the desired thickness $t_2$.

Another aspect of the invention provides an engine block assembly 38 for an internal combustion engine including the cylinder liner 20 with the bonding layer 24, and a method of manufacturing the engine block assembly 38, as shown in FIGS. 3-7. The engine block assembly 38 includes a plurality of the cylinder liners 20, wherein each of the cylinder liners 20 includes the liner member 22 and the bonding layer 24 applied by a thermal spray method, as described above. The engine block assembly 38 also includes the block 26 formed of the second aluminum-based material and presenting a plurality of bores 40 each for receiving one of the cylinder liners 20. The machined first portion of the cylinder liner 20 with the bonding layer 24 is typically located adjacent the top end 28 of the liner member 22 and positioned upwards in the engine block 26 toward a manifold. However, the machined first portion could be in other locations, as described above. The top end 28 of the liner member 22 is disposed slightly below an upper surface 48 of the engine block 26.

The liner member 22 is formed of a metal material different from the aluminum-based materials of the layer and the block 26. In the exemplary embodiment, the liner member 22 is formed of the first aluminum-based material and is physically and chemically bonded to the second aluminum-based material of the block 26 along the bores 40. The second aluminum-based material of the engine block 26 is preferably the same as or similar to the first aluminum-based material of the cylinder liner 20 and thus the two materials form an intermetallic bond including a homogeneous mixture of the first aluminum-based material and the second aluminum-based material during the casting process. The intermetallic bond increases thermal conductivity of the resulting engine block assembly 38 because heat from the liner member 22 can flow through the liner member 22 and through the bonding layer 24 to the block 26. The bonding layer 24 also reduces any distortion of the bore 40 and bridges areas.

The engine block 26 of the exemplary embodiment presents a cooling chamber 44, also referred to as a water jacket, spaced from each of the bores 40 by the second aluminum-based material of the block 26, as shown in FIGS. 4-6. The engine block 26 also includes a plurality of cooling passages 46, such as drilled holes or saw slots, extending from the cooling chamber 44 and through a portion of said block 26 between said bores 40. The cooing passages convey cooling fluid from the cooling chamber 44 through the engine block 26 to prevent the areas between adjacent bores 40 from overheating.

The upper surface 48 of the engine block 26 presents a plurality of bridge areas 42, and each bridge area 42 is planar and located between adjacent bores 40. The width of each bridge area 42 located between adjacent bores 40 and used to form the cooling chamber 44 and cooling passages 46 is increased when the machined cylinder liner 20 with the bonding layer 24 is used, compared to cylinder liners without the bonding layer 24. FIG. 6 illustrates that the machinable bridge area 42 is increased from $d_1$ to $d_2$ due to the bonding layer 24, wherein $d_1$ is the distance between the second outside diameters $D_2$ of the unmachined section portions of the adjacent cylinder liners 20, and $d_2$ is the distance between the outside diameters $D_3$ of adjacent coated cylinder liners 20. This increased bridge area 42 is an advantage during the manufacturing process as it provides more space which can be used to form the cooling chamber 44 and cooling passages 46.

Another aspect of the invention provides a method of manufacturing an engine block assembly 38. The method generally includes providing a plurality of the cylinder liners 20 including the bonding layer 24 formed of the first aluminum-based material applied to the machined first portion of the liner member 22, disposing the cylinder liners 20 in a mold 50, and casting the second aluminum-based material around the plurality of cylinder liners 20 in the mold 50. An example of the method steps are disclosed in FIG. 7.

The first step of providing the cylinder liners 20 can be conducted as described above. As disclosed in FIG. 7, this portion of the method typically includes machining the outside surface 34 of the first portion of the liner member 22, for example by shot blasting, and then applying the first aluminum-based material to the machined first portion, for example by thermal spraying.

The coated cylinder liners 20 are then positioned in the mold 50. The casting step includes providing the second aluminum-based material in molten form and pouring the second aluminum-based material into the mold 50 to form the engine block 26. The second aluminum-based material physically and chemically bonds to the first aluminum-based material of the bonding layer 24 during the casting step. The mechanical and intermetallic bond created during the casting step helps ensure that the cylinder liner 20 is strongly bonded to the engine block 26.

After the engine block 26 is cooled and solidified, it is removed from the mold 50. Thereafter, the engine block 26 is machined and/or drilled as desired or required, typically to form the bridge areas 42, cooling chamber 44, and cooling passages 46, as described above.

Obviously, many modifications and variations of the present invention are possible in light of the above teachings and may be practiced otherwise than as specifically described while within the scope of the appended claims.

What is claimed is:

1. A cylinder liner comprising, a liner member extending longitudinally from a top end to a bottom end and presenting a length between said top and bottom ends;

said liner member including an inside surface extending around a center axis and an oppositely facing outside surface;

said outside surface presenting a first outside diameter along a first portion of said length and a second outside diameter along a second portion of said length, said first outside diameter being less than said second outside diameter; and a bonding layer formed of an aluminum-based material applied to said outside surface along said first portion, wherein said bonding layer of an aluminum-based material is applied to said outside surface by thermal spraying.

2. The cylinder liner of claim 1, wherein said liner member is formed of a metal material different from said aluminum-based material.

3. The cylinder liner of claim 1, wherein said outside surface presents a plurality of depressions each having a depth of not greater than 1 millimeter along said first portion.

4. The cylinder liner of claim 1, wherein said first portion is 10 to 50% of said length of said outside surface.

5. The cylinder liner of claim 1, wherein said first portion of said outside surface is located adjacent to one of said ends of said liner member and said second portion extends from said first portion to the opposite end of said liner member.

6. The cylinder liner of claim 1, wherein said liner member is formed of cast iron;

said inside surface of said liner member extends circumferentially around said center axis and presents a cylindrical-shaped opening extending from said top end to said bottom end;

said length of said liner member is from 100 millimeters to 150 millimeters;

said first portion of said outside surface is 10 to 50% of said length of said liner member;

said outside surface is machined a distance radially relative to said center axis to present said first outside diameter being less than said second outside diameter;

said outside surface presents a plurality of depressions each having a depth of not greater than 1 millimeter along said first portion;

said liner member has a thickness extending from said inside surface to said outside surface, said thickness is at least 1.8 millimeters along said first portion, and said thickness along said first portion is 10 to 15 millimeters less than said thickness along said second portion;

said bonding layer covers said outside surface along said first portion entirely;

said aluminum-based material of said bonding layer is an aluminum alloy;

said aluminum alloy includes aluminum in an amount of 85 to 90 weight percent (wt. %), silicon in an amount of 10 to 15 wt. %, oxygen in an amount of 0.05 to 0.15 wt. %, and optionally Fe, Mg, Zn, and Mn in a total amount less than 1 wt. %, based on the total weight of said aluminum alloy;

said bonding layer has a porosity of less than 5%, a thermal conductivity of 80 to 120 W/mK at 50 to 400° C., a thermal expansion coefficient of 20 to $24\times10^{-6}$/K at 20 to 150° C., a tensile strength of at least 170 MPa, and an elastic modulus of 40 to 70 GPa; and said bonding layer has a thickness of not greater than 15 millimeters.

7. A method of manufacturing a cylinder liner, comprising the steps of:

providing a liner member extending longitudinally from a top end to a bottom end and presenting a length between the top and bottom ends, the liner member including an inside surface extending around a center axis and an oppositely facing outside surface, the outside surface presenting a first outside diameter along a first portion of the length and a second outside diameter along a second portion of the length, and the first outside diameter being less than the second outside diameter; and applying a layer of an aluminum-based material to the outside surface along the first portion of the length, wherein the step of applying the layer of the aluminum-based material to the outside surface includes thermally spraying the aluminum-based material onto the outside surface.

8. The method of claim 7, including reducing the first outside diameter along the first portion so that the first outside diameter is less than the second outside diameter.

9. The method of claim 7, including shot-blasting the outside surface along the first portion to form a plurality of depressions each having a depth of not greater than 1 millimeter.

10. The method of claim 7, wherein the liner member is formed of a metal material different from the aluminum-based material.

11. An engine block assembly, comprising:

a plurality of cylinder liners, each cylinder liner including a liner member extending longitudinally from a top end to a bottom end and presenting a length between said top and bottom ends, said liner member including an inside surface extending around a center axis and an oppositely facing outside surface, said outside surface presenting a first outside diameter along a first portion of said length and a second outside diameter along a second portion of said length, and said first outside diameter being less than said second outside diameter;

each of said cylinder liners including a layer of a first aluminum-based material applied to said outside surface along said first portion, wherein said layers of a first aluminum-based material are applied to said outside surfaces of said cylinder liners by thermal spraying;

a block formed of a second aluminum-based material and presenting a plurality of bores each for receiving one of said cylinder liners; and said first aluminum-based material of said cylinder liners being bonded to said second aluminum-based material of said block.

12. The engine block assembly of claim 11, wherein said first aluminum-based material of said cylinder liners is the same as said second aluminum-based material of said block.

13. The engine block assembly of claim 11, wherein said liner member is formed of a metal material different from said aluminum-based materials of said layer and said block.

14. An engine block assembly, comprising:

a plurality of cylinder liners, each cylinder liner including a liner member extending longitudinally from a top end to a bottom end and presenting a length between said top and bottom ends, said liner member including an inside surface extending around a center axis and an oppositely facing outside surface, said outside surface presenting a first outside diameter along a first portion of said length and a second outside diameter along a second portion of said length, and said first outside diameter being less than said second outside diameter:

each of said cylinder liners including a layer of a first aluminum-based material applied to said outside surface along said first portion;

a block formed of a second aluminum-based material and presenting a plurality of bores each for receiving one of said cylinder liners; and said first aluminum-based material of said cylinder liners being bonded to said second aluminum-based material of said block, wherein said block presents a cooling chamber spaced from each of said bores by said second aluminum-based material, said block includes an upper surface presenting a plurality of bridge areas, each bridge area is planar and located between adjacent bores, said block includes a plurality of cooling passages each extending from said cooling chamber and through a portion of said block between said bores for conveying cooling fluid from said cooling chamber.

15. A method of manufacturing an engine block assembly, comprising the steps of:

providing a plurality of cylinder liners, each cylinder liner including a liner member extending longitudinally from a top end to a bottom end and presenting a length between the top and bottom ends, the liner member including an inside surface extending around a center axis and an oppositely facing outside surface, the outside surface presenting a first outside diameter along a first portion of the length and a second outside diameter along a second portion of the length, and the first outside diameter being less than the second outside diameter, each of the cylinder liners including a layer of a first aluminum-based material applied to the outside surface along the first portion;

disposing the plurality of cylinder liners in a mold; and casting a second aluminum-based material around the plurality of cylinder liners in the mold.

16. The method of claim 15, wherein the second aluminum-based material bonds to the first aluminum-based material during the casting step.

17. The method of claim 15, wherein the liner member is formed of a metal material different from the aluminum-based materials of the layer and the block.

18. The method of claim 15, including applying the first aluminum-based material to the outside surface by thermal spraying.

* * * * *